United States Patent [19]

van Roosmalen et al.

[11] 4,276,494

[45] Jun. 30, 1981

[54] CATHODE RAY TUBE WITH TRANSVERSELY SUPPORTED ELECTRODE AND CONDUCTIVE WALL COATING

[75] Inventors: Johannes H. T. van Roosmalen; Gerardus A. H. M. Vrijssen, both of Eindhoven, Netherlands

[73] Assignee: U.S. Philips Corporation, New York, N.Y.

[21] Appl. No.: 56,480

[22] Filed: Jul. 11, 1979

[30] Foreign Application Priority Data

Jul. 20, 1979 [NL] Netherlands ..... 7807758

[51] Int. Cl.[3] ..... H01J 29/02; H01J 29/88

[52] U.S. Cl. ..... 313/479; 313/283; 313/390; 313/482

[58] Field of Search ..... 313/482, 283, 284, 383, 313/390, 450, 451, 479

[56] References Cited

U.S. PATENT DOCUMENTS

| | | | |
|---|---|---|---|
| 2,828,433 | 3/1958 | Frenkel | 313/482 |
| 2,938,134 | 5/1960 | Levin | 313/444 |
| 2,946,910 | 7/1960 | Spinnler et al. | 313/283 X |
| 3,188,506 | 6/1965 | Rome | 313/390 |
| 3,912,851 | 10/1975 | Vrijssen et al. | 313/482 X |
| 4,182,973 | 1/1980 | Vrijssen et al. | 313/482 X |

FOREIGN PATENT DOCUMENTS 431246 7/1935 United Kingdom .

*Primary Examiner*—Palmer C. Demeo

[57] ABSTRACT

In a cathode-ray tube, in particular a camera tube, the inner wall of the glass envelope is coated with an electrically conductive material interrupted in the proximity of electrodes extending transversely to the wall coating and supported by transversely extending supporting surfaces. At the area of each of the interruptions the envelope has a stepwise decrease of the inside diameter in two steps. In the direction of decreasing diameter the first of these steps constitutes the supporting surface for the transverse electrode and the interruption in the wall coating is provided on a wall portion of the second of these steps. The interruptions provided in this manner do not exert any disturbing influence on the electron beam in the tube.

5 Claims, 6 Drawing Figures

CATHODE RAY TUBE WITH TRANSVERSELY SUPPORTED ELECTRODE AND CONDUCTIVE WALL COATING

BACKGROUND OF THE INVENTION

The invention relates to a cathode-ray tube and more particularly, but not exclusively, to a television camera tube.

A television camera tube disclosed in U.S. Pat. No. 3,912,851 comprises a tubular envelope portion of insulating material having an internally provided electrically conductive wall coating and at least one electrode extending transversely to the wall coating, the electrode being supported in the envelope portion by a supporting surface extending transversely to the longitudinal axis of the envelope portion, and the supporting surface being formed by an envelope portion whose internal transverse dimensions decrease in a substantially stepwise manner. In this case the gauze electrode bears on a shoulder formed by a local restriction of the envelope and is secured to the tube wall by means of indium.

U.S. Pat. No. 2,938,134 discloses an electron gun system of which a number of electrodes are supported in an envelope by supporting surfaces which have been obtained by a stepwise narrowing of the inside diameter of the envelope. The electrodes are urged against the supporting surfaces by resilient means.

Netherlands Patent Specification No. 42,114, to which British Pat. No. 431,246 corresponds, discloses a cathode-ray tube in which the electrodes are placed in a cylindrical insulating member provided inside the tube. The insulation member comprises steps to which the electrodes having a resilient edge are clamped. A part of the inner wall of the insulation member is coated with an electrically conductive layer.

The present development of cathode ray tubes and in particular that of television camera tubes is directed more and more to the manufacture of small tubes subjected to narrow tolerances. This development is associated with a simplification of the tube construction in particular as regards the construction of the electrode system used in the tube. If possible, the electrodes are replaced by wall electrodes in the form of thin-film electrodes provided on the inner wall of the envelope of the tube. However, a problem is that the necessary interruptions in the conductive wall coating, to obtain wall electrodes which are electrically insulated from each other, may cause a local disturbance of the electric field distribution in the tube. Such a disturbance is caused mainly by electric charge of the tube wall at the area of an interruption in the conductive wall coating. The influence of such a disturbance of the electric field distribution on, for example, the path of rays of an electron beam generated in the tube is more disturbing as the interruption is less rotationally symmetrical and as the inside diameter of the tube envelope is smaller. Field disturbances may furthermore be caused by the connections with which, for example, gauze electrodes and electrodes to limit the diameter of an electron beam, for example a diaphragm, are connected to a conductive wall coating.

SUMMARY OF THE INVENTION

It is an object of the invention to provide a construction in which an interruption in the conductive wall coating does not produce undesired disturbance of the electric field distribution in the tube. According to the present invention, a television camera tube of the kinds described above is characterized in that the conductive wall coating is interrupted in the proximity of the electrode extending transversely to the wall coating and the stepwise decrease of the inside transverse. dimensions of the envelope portion takes place in at least a first and a second step, in which, measured in the direction of decreasing transverse dimension, the first step forms the supporting surface for the electrode and the interruption in the conductive wall coating is provided on a wall portion of the second step. the interruption in the conductive wall coating thus is at a location where it has no electron-optical influence on the path of the electron rays in the electron beam. Stringent requirements need not be imposed either on the rotational symmetry of the interruptions so that these can be provided in the conductive wall coating in a comparatively rough manner, for example, by means of grinding. In an embodiment of the present invention the interruption in the wall coating is situated at a distance a from the edge of the second step facing the longitudinal axis of the envelope portion and the distance between the electrode supported by the supporting surface of the first step and the part of the second step extending transversely to the longitudinal axis of the envelope is b, the relation between said distances is preferably chosen to be so that $a>0.5\ b$.

The supporting surface formed by the first step accurately determines the position of the electrode in the envelope. In order to fix this position, the electrode is secured to the tube wall. This connection, too, may have no electron-otpical influence on the formation of the electron beam and may be realized in that on its side remote from the supporting surface, the electrode is connected electrically and mechanically to the conductive wall coating. When connected in this manner, the connection of the electrode is situated in a field-free or substantially field-free space.

By thus avoiding disturbing influences on the field distribution in the tube, it has proved worth while to subject the electrode construction to very narrow tolerances as regards the positioning, the longitudinal dimensions and transverse dimensions of the electrodes. Tolerances better than 2 $\mu$m can be obtained when the tubular envelope portion consists of a glass tube having an internally profiled wall obtained by drawing on a profiled metal mandril. This has the additional advantage that the steps necessary to support the electrodes in the tube are obtained in a simple manner and in one operation.

BRIEF DESCRIPTION OF THE DRAWING

Embodiments of the invention will now be described by way of example with reference to the accompanying drawing, in which.

DESCRIPTION OF THE PREFERRED EMBODIMENTS

Figure 1:
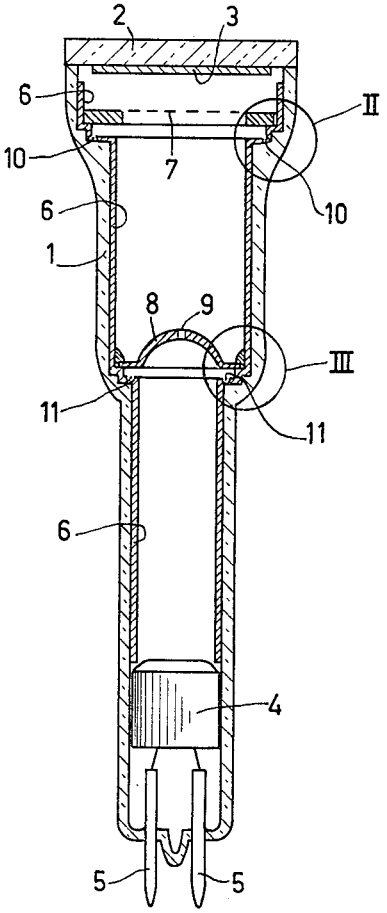
FIG. 1 is a sectional view of a first embodiment of a television camera tube, FIGS. 2 and 3 respectively show in greater detail the encircled portions reference II and III of the tube shown in FIG. 1, FIGS. 4 and 5 illustrate two phases of the manufacturing process of the tube shown in FIG. 1.
Figure 2:
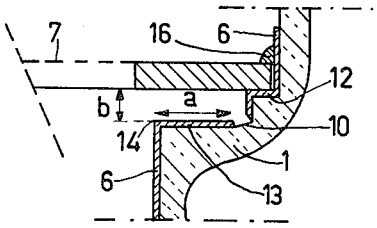
Figure 3:
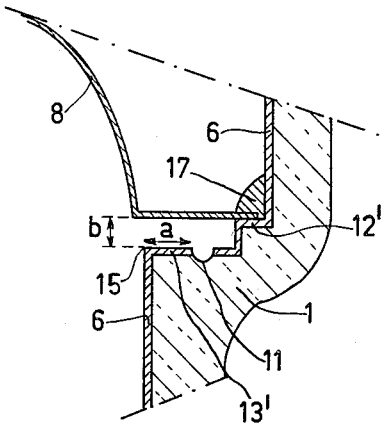

The camera tube shown in FIG. 1, in which details not essential to the understanding of the invention have been omitted, comprises a glass envelope 1 which is sealed at one end by means of a glass window 2 having a photosensitive layer 3. An electron gun 4 to which the desired electric voltages can be supplied via a number of lead-through pins 5 is situated in the tube. The inner wall of the envelope 1 is covered by a thin nickel layer 6 by means of a known process, for example, electroless nickel-plating. The tube furthermore comprises a gauze electrode 7 and a diaphragm 8 having an aperture 9 through which an electron beam generated by the electron gun 4 passes before landing on the photosensitive layer 3. The nickel layer 6 is interrupted in the circumferential direction in the proximity of the gauze electrode 7 and the diaphragm 8, so that the layer 6 is separated into three portions. Each of these portions constitutes a wall electrode which contributes to the formation of a spot of the electron beam on the photosensitive layer 3 which is desired as regards shape and dimensions. In order to minimize field disturbing influences of the interruptions in the layer 6 denoted by 10 and 11, the inside diameter of the envelope 1 is reduced in steps at the area of the gauze electrode 7 and the diaphragm 8, as is shown in detail in FIGS. 2 and 3. Each of these reductions takes place in first steps 12, 12' and second steps 13, 13'. The first steps 12 and 12' respectively, constitute a supporting face for the gauze electrode 7 and the diaphragm 8, respectively. The interruptions 10 and 11 are provided in a wall portion of the second steps 13 and 13', respectively. These interruptions have been obtained by locally grinding away the wall coating 6. The location of the interruptions 10 and 11 is such that electron-optically they cannot exert any disturbing influence on the shape and direction of the electron beam. The distance a between the interruption (10, 11) and the edge (14, 15) of the second step (13, 13') is for that purpose larger than half the distance b between the electrode (7, 8) and the portion of the second step (13, 13') extending transversely to the longitudinal axis of the tube. The gauze electrode 7 and the diaphragm 8 are connected mechanically and electrically to the nickel layer 6 by means of a bead of indium (16, 17) on the sides remote from the supporting surfaces. The beads of indium (16, 17) thus are situated in a field-free space so that they, too, cannot exert any disturbing influence on the shape and direction of the electron beam.

Figure 4:
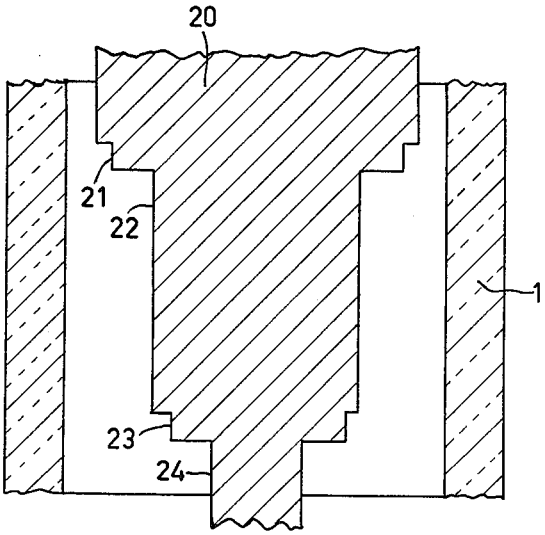
Figure 5:
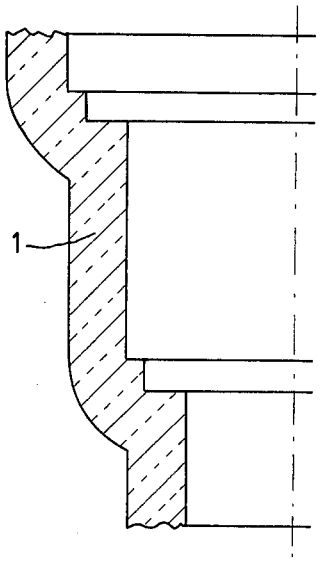

FIG. 4 is a sectional view of a part of the tube envelope 1 in a phase of the manufacturing process in which the envelope is not yet provided with a profiled inner wall. Present in the envelope is a metal mandril 20 which has stepwise variations in diameter 21, 22, 23 and 24 in accordance with the profile to be provided in the inner wall of the envelope 1. The glass envelope 1 is softened by heating and drawn or pressed against the mandril 20 which is also heated so that the glass will engage the mandril and will be profiled in accordance with the shape of the mandril. After cooling, the mandril which is manufactured from a metal having a larger coefficient of expansion than that of the glass is removed from the envelope 1. The envelope then has the shape as shown in FIG. 5 and the inside dimensions both in the axial and in the radial directions are held to an accuracy of 2 $\mu$m.

Figure 6:
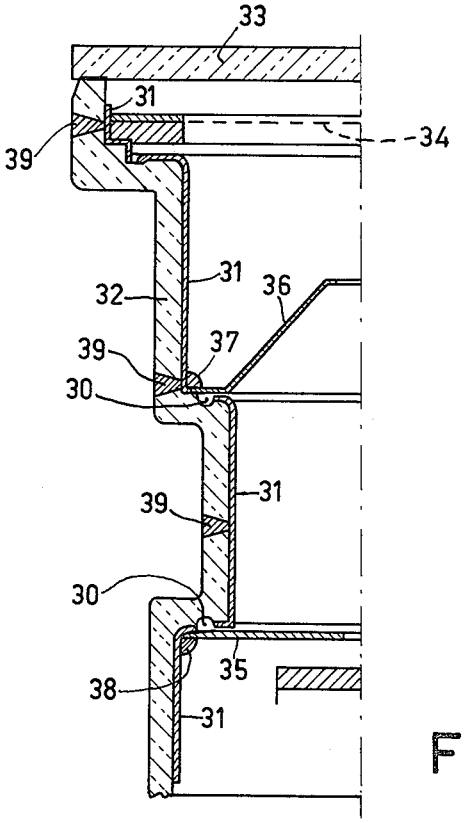
FIG. 6 shows diagrammatically another embodiment of a televsion camera tube.

FIG. 6 shows another embodiment of a camera tube embodying the invention. In accordance with the embodiment shown in FIG. 1, interruptions 30 are provided in this case also in the conductive wall coating 31 of the glass tube envelope 32. The envelope is sealed again by means of a window 33 and provided with a gauze elecrode 34. The tube further comprises a first diaphragm 35 and a second diaphragm 36 which are secured to the wall coating 31 by means of indium beads 37 and 38. The parts of the wall coating separated by the interruptions 30 can be brought at the desired potentials by means of electric leadthroughs 39. The shape of the envelope 32 obtained by drawing is such that for the manufacture thereof, a mandril in two parts may be used in the manner described with reference to FIG. 4.

What is claimed is:

1. A cathode-ray tube comprising a tubular envelope portion of insulating material having an internally provided electrically conductive wall coating and at least one electrode extending transversely to the wall coating, said electrode being supported in the envelope by a supporting surface extending transversely to the longitudinal axis of the envelope portion, said supporting surface being formed by a substantially stepwise reduction of the inside transverse dimensions of the envelope portion, characterized in that the conductive wall coating is interrupted in the proximity of the electrode extending transversely to the wall coating, and the stepwise reduction is in the form of at least a first and a second step, in which, measured in the direction of decreasing transverse dimension, the first step forms the supporting surface for the electrode and the interruption in the conductive wall coating is provided on a wall portion of the second step.

2. A cathode-ray tube as claimed in claim 1, characterized in that the interruption in the wall coating is situated at a distance a from the edge of the second step facing the longitudinal axis of the envelope portion and the distance between the electrode supported by the supporting surface of the first step and the part of the second step extending transversely to the longitudinal axis of the envelope is b, in such manner that $a > 0.5$ b

3. A cathode-ray tube as claimed in claim 1 or 2, characterized in that on its side remote from the supporting surface the electrode is connected mechanically and electrically to the conductive wall coating.

4. A cathode-ray tube as claimed in claim 1 or 2, characterized in that the tubular envelope portion consists of a glass tube having an internally profiled wall obtained by drawing on a profiled mandril.

5. A cathode-ray tube as claimed in claim 4, characterized in that on its side remote from the supporting surface the electrode, is connected mechanically and electrically to the conductive wall coating.

* * * * *